US008789288B2

(12) United States Patent
Lim

(10) Patent No.: US 8,789,288 B2
(45) Date of Patent: Jul. 29, 2014

(54) PEDESTAL DRYING MACHINE USING PTC HEATER

(75) Inventor: Min Kyu Lim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 641 days.

(21) Appl. No.: 12/310,323

(22) PCT Filed: Aug. 20, 2007

(86) PCT No.: PCT/KR2007/003969

§ 371 (c)(1),
(2), (4) Date: Feb. 20, 2009

(87) PCT Pub. No.: WO2008/023910

PCT Pub. Date: Feb. 28, 2008

(65) Prior Publication Data

US 2009/0277037 A1 Nov. 12, 2009

(30) Foreign Application Priority Data

Aug. 22, 2006 (KR) ..... 10-2006-0079429

(51) Int. Cl.
*F26B 19/00* (2006.01)
*F26B 3/00* (2006.01)

(52) U.S. Cl.
USPC ..... 34/215; 34/488; 34/508

(58) Field of Classification Search
USPC ..... 34/215, 90, 218, 239, 242, 595, 601, 34/602, 603, 443, 463, 487, 508, 488; 312/330.1; 38/14
See application file for complete search history.

(56) References Cited

U.S. PATENT DOCUMENTS

| | | | | | |
|---|---|---|---|---|---|
| 3,402,477 | A * | 9/1968 | Hubbard | ..... | 34/543 |
| 5,016,364 | A * | 5/1991 | Cochrane | ..... | 34/202 |
| 5,651,194 | A * | 7/1997 | Hayashi | ..... | 34/550 |
| 5,666,743 | A * | 9/1997 | Dawson | ..... | 34/219 |
| 7,913,419 | B2 * | 3/2011 | Tomasi et al. | ..... | 34/595 |
| 2005/0132603 | A1 * | 6/2005 | Jeong et al. | ..... | 34/603 |
| 2005/0275325 | A1 | 12/2005 | Yang et al. | | |
| 2006/0112585 | A1 | 6/2006 | Choi et al. | | |
| 2007/0101605 | A1 * | 5/2007 | Susalla | ..... | 34/202 |
| 2007/0240328 | A1 * | 10/2007 | Moles | ..... | 34/218 |

FOREIGN PATENT DOCUMENTS

| | | | | | |
|---|---|---|---|---|---|
| CN | 2252823 | | 4/1997 | | |
| CN | 2252823 | Y * | 4/1997 | ..... | D06F 58/00 |
| CN | 2633924 | Y | 8/2004 | | |
| CN | 1572966 | A | 2/2005 | | |
| EP | 0 501 747 | A1 | 9/1992 | | |
| EP | 1 146 161 | | 10/2001 | | |
| EP | 1 439 258 | A2 | 7/2004 | | |
| EP | 1 621 660 | | 2/2006 | | |
| JP | 54-108060 | A | 8/1979 | | |

(Continued)

*Primary Examiner* — Kenneth Rinehart
*Assistant Examiner* — John McCormack
(74) *Attorney, Agent, or Firm* — McKenna Long & Alridge LLP

(57) ABSTRACT

The present invention relates to a new conceptual pedestal type dryer which serves both as a pedestal of a washing machine or dryer, and a dryer, and particularly, to a pedestal type dryer with a PTC heater. The pedestal type dryer includes a container having a space formed therein for holding a drying object, and a top provided to install a laundry dryer, or a washing machine, and a hot air supply unit having a fan for blowing air, and a PTC heater, for supplying hot air to the space for holding the drying object.

7 Claims, 5 Drawing Sheets

(56) References Cited

FOREIGN PATENT DOCUMENTS

| | | |
|---|---|---|
| JP | 1-026399 | 1/1989 |
| JP | 2004-313417 | 11/2004 |
| KR | 10-0141778 | 3/1998 |
| KR | 10-2005-0115971 | 12/2005 |
| SU | 242774 | 4/1969 |
| WO | WO 2008/023910 | 2/2008 |

* cited by examiner

PEDESTAL DRYING MACHINE USING PTC HEATER

This application is a 35 U.S.C. §371 National Stage entry of International Application No. PCT/KR2007/003969, filed on Aug. 20, 2007, and claims priority to Korean Application Nos. KR 10-2006-0079429, filed on Aug. 22, 2006 which is hereby incorporated by reference in their entireties.

TECHNICAL FIELD

The present invention relates to a new conceptual pedestal type dryer which serves both as a pedestal of a washing machine or dryer, and a dryer, and particularly, to a pedestal type dryer with a PTC heater.

BACKGROUND ART

In general, a laundry treating machine is a machine which can wash, dry, or wash and dry the laundry. The laundry treating machine can perform a washing or drying function or both the washing and drying functions. Recently, laundry treating machines each having a steam generator are come into wide use, which provides a refresh function, such as removal of creases, deodoring, removal of static electricity, and so on, from the laundry.

In the meantime, according to directions of laundry introduction/taking out, in related art laundry machines, there are front loading type laundry treating machines and top loading type laundry treating machines. According to washing systems, there are upright type laundry treating machines in each of which a pulsator or a washing tub rotates, and a horizontal type laundry treating machines in each of which a drum rotates. Typical examples of the horizontal type laundry treating machines are the drum type washing machines or dryers.

Currently, it is a trend that the laundry treating machines become gradually larger for meeting user's demands. That is, sizes of domestic laundry treating machines become larger, gradually.

In the meantime, of the related art laundry treating machines, there are cases when the washing machines are not provided with the drying function. Consequently, if the user needs the drying function, additional provision of a dryer or a washing and drying machine is required. Accordingly, in order to perform both the washing and drying, an expense of the consumer can not, but increase.

Since sizes of all of the related art dryers are large, there has been a limitation in an installation space for installation both of the washing machine and the dryer.

Moreover, in the laundry treating machine having the drying function, as the laundry treating machine becomes the larger gradually, driving of the large sized dryer even in a case a small amount of laundry is dried is not favorable in view of energy saving.

In a case of the drum type dryer, since the drum rotates to tumble a drying object, the drum type dryer is not suitable for drying shoes. Moreover, in many cases in washing the shoes, though a small amount of shoes, in a range of 1 or to pairs of shoes, are dried, if the related art dryer is used for drying such a small amount of drying object, it is not efficient in view of energy saving because driving of the drum, large capacity heater, and fan is required.

FIG. 1 illustrates a perspective view of a related art laundry treating machine.

Referring to FIG. 1, the related art laundry treating machine is provided with a body 10 which forms an exterior of the laundry treating machine, and a control panel 11 on a front or top of the body 10. The control panel may be provided with a control unit for controlling operation of the laundry treating machine. Therefore, by operating the control unit, the user can treat laundry, such as washing or drying.

The laundry treating machine may be a washing machine, a dryer, or a washing and drying machine.

In the meantime, the related art laundry treating machine may be provided with a pedestal 20. In this instance, the body 10 is placed on the pedestal 20.

The pedestal has been used only for supporting the related art washing machine or dryer merely, but not for other purposes.

DISCLOSURE OF INVENTION

Technical Problem

To solve the problems, an object of the present invention is to provide a pedestal type laundry treating machine which enables drying a small amount of drying object, without operating a relatively large laundry treating machine, as well as serving as a pedestal of the dryer or a washing machine.

Another object of the present invention is to provide a pedestal type dryer which is favorable Or energy saving, noiseless, and compact, since, different from the related art dryer, the pedestal type dryer is not the drum type dryer.

Another object of the present invention is to provide a pedestal type dryer in which a leakage current intensity is made not strong even if a current leakage accident takes place at a heater, for preventing accident caused by negligence of safety.

Technical Solution

To achieve these objects and other advantages and in accordance with the purpose of the invention, as embodied and broadly described herein, a pedestal type dryer includes a container having a space formed therein for holding a drying object, and a top provided to install a laundry dryer, or a washing machine, and a hot air supply unit having a fan for blowing air, and a PTC heater, for supplying hot air to the space for holding the drying object.

It is preferable that the pedestal type dryer is positively secured to the washing machine or a dryer installed thereon with joining means. The positive securing of the pedestal type dryer to the washing machine or the dryer is required due to vibration coming from rotation of a drum in the washing machine or the dryer.

The container is fabricated structurally strong for providing a space for holding a drying object therein while supporting the dryer or the washing machine to be placed thereon.

The PTC heater is formed of PTC elements each of which resistance increases as a temperature rises. Consequently, if the temperature of the heater rises to a temperature required or drying, the resistance of the PTC heater increases, to drop a current intensity.

Different from the related art laundry dryer, the pedestal type dryer has a size comparatively small to have a space limitation in providing required devices therein. According to this, a space the drying object is mounted therein and a place the heater is mounted thereto can be adjacent to each other, to make access to the heater easy as much as they are adjacent.

Such easy accessibility is liable to cause that a playful child's hand or a portion of a wet drying object comes into touch to the heater. In this case, if the heater has an electric wire as in the case of the related art laundry dryer, an accident caused by negligence of safety can happen.

If the heater has an electric wire as in the case of the related art laundry dryer, a measure stronger than the related art dryer is required for the accident caused by leakage of current, which raises a cost.

The pedestal dryer may have structure in which the space for holding the drying object and the space for mounting the heater therein are isolated only with a partition wall, when, if there is a leakage current from the heater, a leakage current flows to the space for holding the drying object directly, to cause a problem.

Because an inside of a drum which is a space Or holding the drying object and a space for mounting the heater therein are spaced much from each other, and there is comparatively much space to be used, the related art laundry dryer is easy to provide a measure for the leakage current from the heater. Even if there is the leakage current from the heater, there is almost no occasion of the leakage current flowing to the inside of the drum.

However, due to the compact structure, the pedestal type dryer of the present invention has a relatively high probability of the leakage current flowing to the space for holding the drying object if there is the leakage current from the heater.

Moreover, there is a relatively high probability that the leakage current is liable to flow to an outside of the case of the pedestal type dryer, to cause a trouble.

Accordingly, the pedestal type dryer of the present invention solves the problem of accident caused by leakage of current by providing a heater of PTC elements.

Along with this, different from electric wire, since the PTC heater is formed by powder molding, the PTC heater can be shaped as desired, which is favorable for securing a heater mounting space, and suitable to the pedestal type dryer of the present invention which has much spatial limitation.

It is preferable that the pedestal type dryer includes a steam supply unit for supplying steam to the drying object.

Preferably, the container includes a drawer drawable in a front direction. The drawer is advantageous in that in/out of the laundry, and washing thereof is easy.

The container may include an inlet in an upper portion of a rear wall for introduction of the air, and an outlet in a lower portion of the rear wall for discharging the air, and the heater is located in front of the inlet. Preferably, the drawer is in communication with the inlet through the upper portion of the rear wall thereof and in communication with the outlet through the lower portion of the rear wall thereof.

It is preferable that the heater is located in front of the inlet, and the fan is located in front of the outlet.

It is preferable that the fan, the PTC heater, and the steam supply unit are provided between the rear wall of the drawer and the rear wall of the body.

The pedestal type dryer may further include a shelf for seating the drying object thereon. Preferably, the shelf divides the space into an upper portion and a lower portion while enabling communication between the upper portion and the lower portion. For an example, the shelf may have a plurality of pass through holes for communication between the upper portion and the lower portion.

Preferably, the shelf is mounted in a tilted position. It is more preferable that the shelf is tilted down toward a direction of air introduction, or uniform supply of the hot air throughout the drying object on the shelf.

The downward tilting of the shelf is very favorable for drying shoes since water in the shoes flows down and collected at a lower place.

The downward tilting of the shelf makes a circulation of the hot air smooth because the hot air hits the shelf and is directed to the lower portion of the shelf through the pass through hole.

Preferably, there is an air guide provided to the rear wall of the drawer for guiding the air to an upper portion of the drawer. Since the air introduced through the upper portion of the rear wall of the drawer is directed, not downward, but toward the drying object, the drying is more effective and circulation of the hot air is smoother.

As the user can wash or dry a large amount of laundry at the washing machine or the dryer on the pedestal dryer, and dry a small amount of laundry at the pedestal type dryer, use of the machine is convenient and energy can be saved.

Shoes or a cap which has been difficult to dry at the related art drum type dryer can be dried, easily.

Advantageous Effects

A new conceptual pedestal type dryer can be provided, which can dry a small amount of laundry without operating a relatively large laundry treating machine, and also can serve as a pedestal of a dryer or a washing machine.

Different from the related art dryer, a pedestal type dryer can be provided, which is favorable for energy saving, noiseless, compact because the pedestal type dryer is not a drum type dryer.

Moreover, a pedestal type dryer can be provided, which can prevent accident caused by negligence of safety from taking place even when a current leaks from the heater.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

A pedestal type dryer in accordance with a preferred embodiment of the present invention will be described in detail with reference to FIGS. 2 to 4.

Figure 1:
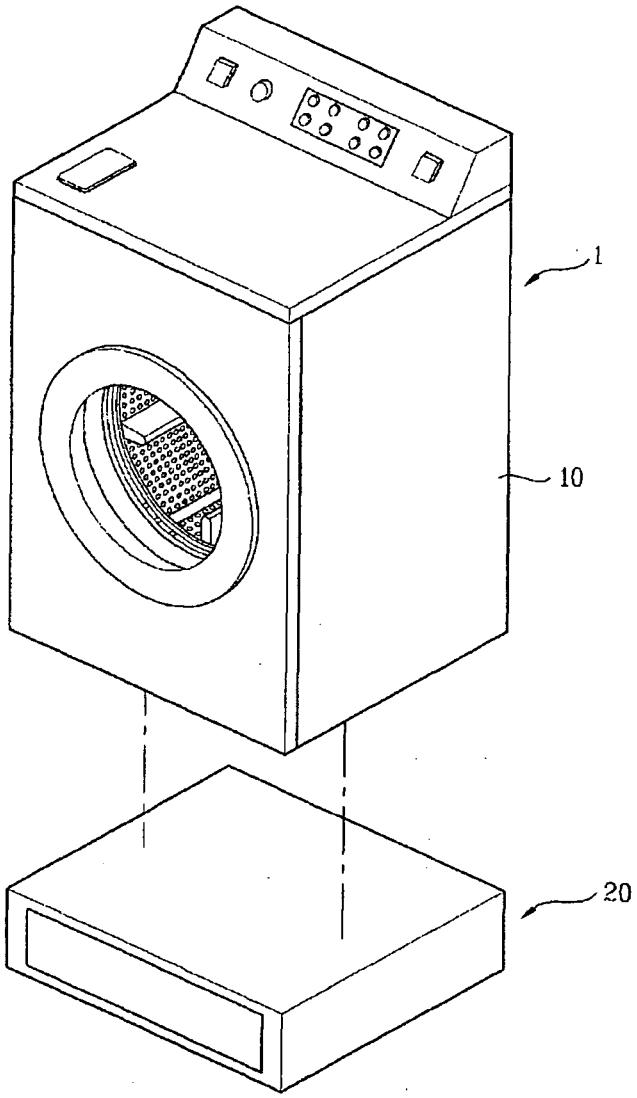
FIG. 1 illustrates a perspective view of a related art laundry treating machine with a pedestal.
Figure 2:
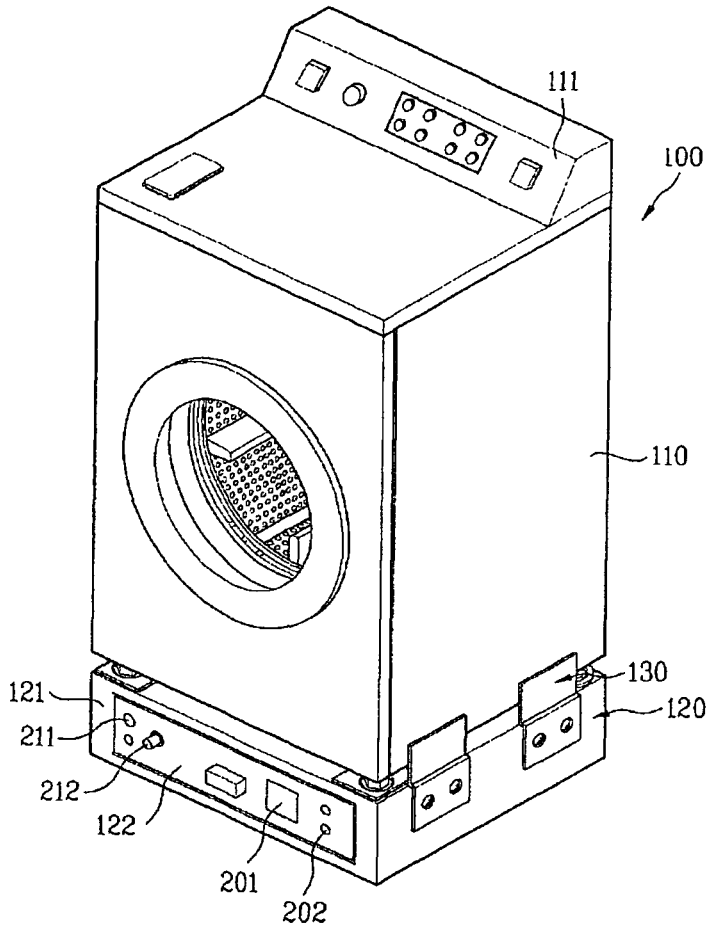
FIG. 2 illustrates a perspective view of a composite laundry treating machine including a pedestal type dryer in accordance with a preferred embodiment of the present invention.

Referring to FIG. 2, the pedestal type dryer 120 serves as a pedestal for a body of a laundry treating machine, such as a washing machine or a dryer.

Figure 3:
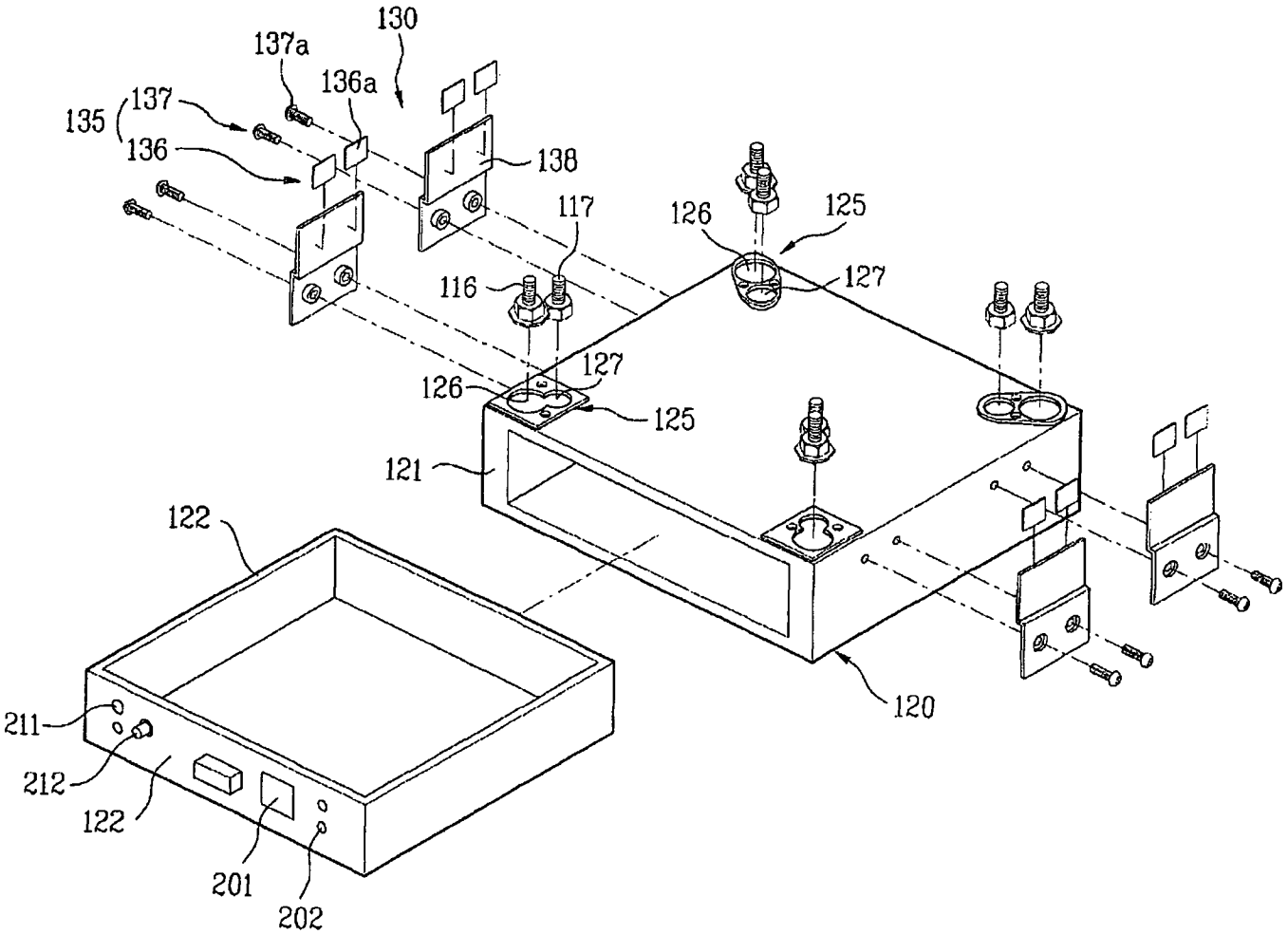
FIG. 3 illustrates an exploded perspective view of a pedestal type dryer in accordance with a preferred embodiment of the present invention.

In the meantime, referring to FIGS. 2 and 3, the pedestal type dryer 120 includes a container 121 having a space firmed therein for holding the laundry, and joining means 130 at an upper portion of the container 121 for joining the body 110 and the container 121 together. The pedestal type dryer 120 supports the body 110 of the dryer or the washing machine at a bottom thereof.

The pedestal type dryer 120 may also include leg supporters 125 provided to a top of the pedestal type dryer 120 for supporting sides of lower legs 116, or 117 of the laundry treating machine.

Each of the leg supporters 125 includes a panel having a first seating hole 126 for seating the washing machine leg 116, and a second seating hole 127 for seating a dryer leg 117, and is fastened to the top of the container 121 of the pedestal type dryer 120 with screws, or the like.

The leg supporters 125 are fixedly secured to corners of the top of the container 121 of the pedestal type dryer 120 respectively, wherein the first seating hole 126 and the second seating hole 127 of each of the two leg supporters at front corners of the container 121 of the pedestal type dryer are joined with each other, and the first seating hole 126 and the second seating hole 127 of each of the two leg supporters at rear corners of the container 121 of the pedestal type dryer are not joined with each other, or easy seating of the washing machine legs 116.

The first seating hole 126 is located on an outer side of the second seating hole 127 with respect to a diagonal line of the underside of the body 110 of the laundry treating machine. This is because, in general, the body of the washing machine is larger than the body of the laundry dryer.

The joining means 130 includes joining members 138 each provided to sides both of the washing machine or the laundry dryer, and the container 121 of the pedestal type dryer under the washing machine or the laundry dryer, and fastening members 135 for fastening the joining member to the sides of the washing machine or the laundry dryer, and the container 121 of the pedestal type dryer.

Referring to FIG. 3, the joining member may include two or more than two joining members 138 each for securing abutted sides of the container 121 of the hexahedral pedestal type dryer, and the body 110 of the hexahedral laundry treating machine, to each other.

In addition to this, the joining member may also include a third fastening member (not shown) for securing abutted rear sides of the container 121 of the pedestal type dryer, and the body 110 of the laundry treating machine, to each other.

In this instance, the joining means 130 may be designed to cope with height changes of the washing machine legs 116 or the laundry dryer legs 117.

The fastening member 135 includes a first fastening member 136 for securing an upper portion of the joining member to a lower portion of a side of the washing machine or the laundry dryer, and a second fastening member 137 for securing a lower portion of the joining member to an upper portion of a side of the pedestal type dryer.

In this instance, at least one of the first fastening member 136 and the second fastening member 137 may be one having adhesive applied to both sides, for an example, two sided tape.

Different from above, at least one of the first fastening member 136 and the second fastening member 137 may be fastening means, such as screws.

If the fastening member is screws, preferably, the upper portion of the joining member has fastening holes armed at fixed intervals.

In the meantime, different from above, the means for joining the body 110 of the laundry treating machine to the container 121 of the pedestal type dryer can be changed in a variety of forms.

In view of stability or exterior design of a composite laundry treating machine, it is preferable that at least one of a left/right direction width and a front/rear direction width of the container 121 of the pedestal type dryer is the same or greater than a left/right direction width and a front/rear direction width of the body 110 of the laundry treating machine.

The pedestal type dryer will be described in detail with reference to FIG. 4.

Figure 4:
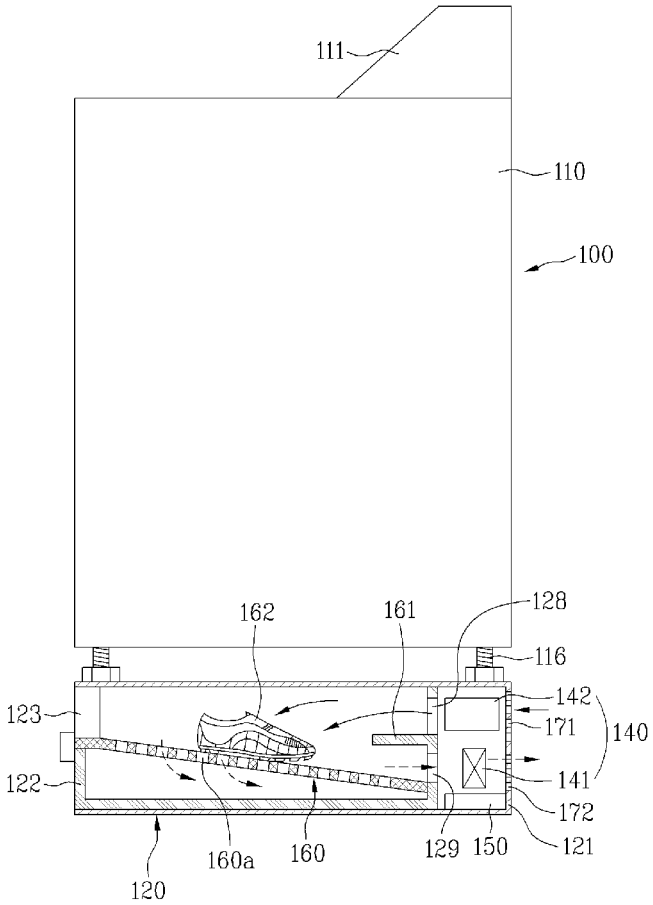
FIG. 4 illustrates a section of a composite laundry treating machine including a pedestal type dryer in accordance with a preferred embodiment of the present invention, schematically.

FIG. 4 illustrates a section of a pedestal type dryer in accordance with a preferred embodiment of the present invention, schematically.

The pedestal type dryer 120 may be joined with the body 110 of the laundry treating machine, to construct one composite laundry washing or drying machine 100. In this case, the laundry treating machine has the laundry introduced to an inside of the body 110, for washing or drying. That is, the laundry treating machine may be a washing machine, a dryer, or a washing and drying machine.

The composite laundry treating machine 100 includes joining means 130 for securing the container 121 of the pedestal type dryer to one side of the body 110 of the laundry treating machine.

The pedestal type dryer 120 has a laundry holding space formed therein. The laundry holding space may have a shape of a drawer 122 which can be drawn in a front direction from the front of the container 121. The pedestal type dryer 120 includes a hot air supply unit 140 in the container 121 of the pedestal type dryer for forced supply of hot air to the space.

The pedestal type dryer 120 includes a steam supply unit 150 in the container 121 for supplying steam to the laundry holding space. The steam supply unit 150 has a spray hole (not shown) for spraying the steam to the space through the top or rear of the body.

In this instance, operation of the hot air supply unit 140 and the steam supply unit 150 is controlled by a main control unit at the controller 123.

The controller includes an input unit and a display unit As the input unit, a knob 212 and various kinds of selection buttons 211 are provided for selecting a drying course, or the like. As the display unit, an LCD screen 201 and LED's 202 are provided.

The hot air supply unit 140 includes a fan 141 for blowing air, and a heater 142 for heating the air. That is, as the fan 141 is driven, external air is introduced into the drawer 122, and discharged to an outside of the drawer, again. The external air is heated at the heater 142, and is introduced into the drawer 122.

The heater 142 is a PTC heater, powder molded PTC elements.

Figure 5:
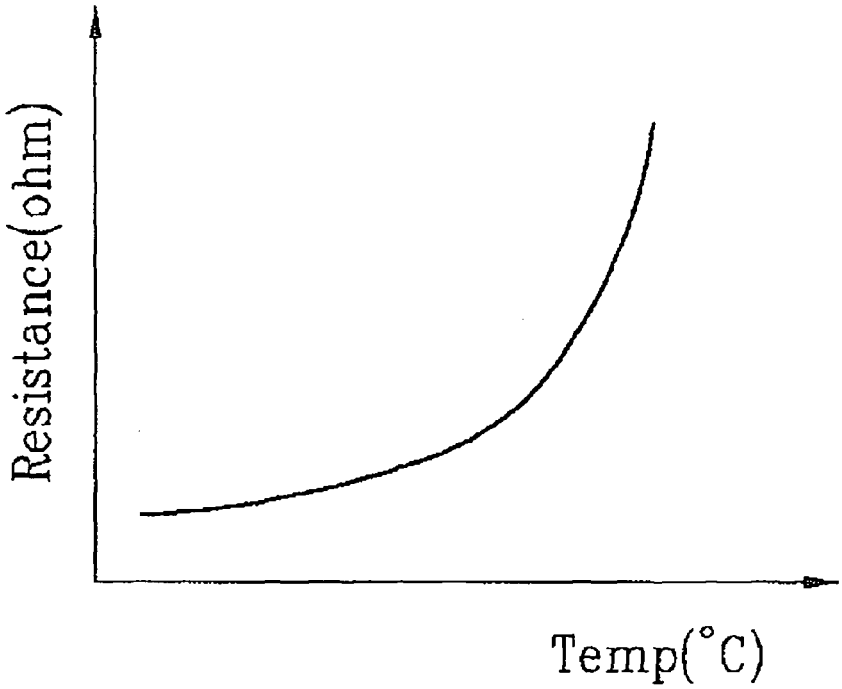
FIGS. 5 and 6 illustrate graphs showing temperature versus resistance and current characteristics of a PTC heater, respectively.
Figure 6:
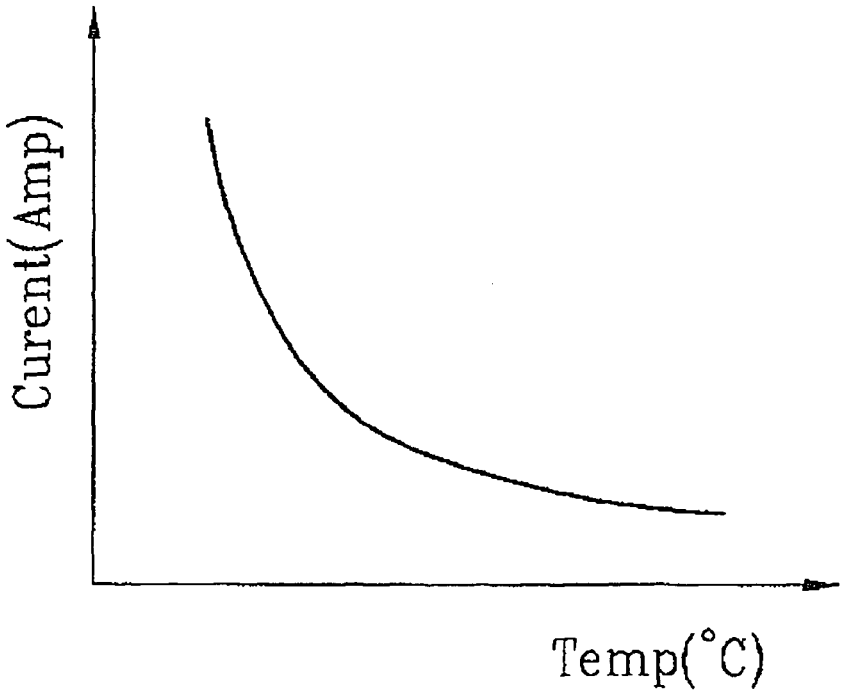

Referring to FIGS. 5 and 6, the PTC heater shows a resistance and a current intensity varied with a temperature. As shown, the resistance increases as the temperature rises, and, according to this, the current intensity to the heater decreases.

If the heater is operated normally, since the current intensity is very low, even if leakage of the current takes place, an accident caused by negligence of safety come from leakage of the current can be prevented.

A plurality of the heaters may be provided, when a temperature of the heater can be controlled according to an object of dry by using a constant temperature heat generating effect at the time of drying. In a case of the drying object formed of a material weak to heat, drying can be performed without giving damage to the drying object. For an example, thermal deformation of rubber of shoes and so on can be prevented.

In this case, the controller has selection related to the drying object received from the user, to heat air with one of the plurality of beaters selected according to the selection.

The steam supply unit 150 supplies the steam to the drawer 122. The steam is brought into contact with laundry in the drawer 122, to come into contact with the laundry in the drawer 122 to sterilize and remove creases from the laundry.

According to this, the pedestal type dryer 120 can perform a refresh function by using the steam supply unit 150.

Of course, the pedestal type dryer 120 can perform the refresh function as well as the drying function.

In the meantime, it is preferable that the container 121 of the pedestal type dryer has an inlet 171 in an upper portion of the rear wall for introduction of the air to the container 121, and an outlet 172 in a lower portion of the rear wall for discharging the air from the container 121. The drawer 122 is in communication with the inlet 171 through the upper portion of the rear wall thereof, and the drawer 122 is in communication with the outlet 172 through the lower portion of the rear wall thereof Accordingly, external air is introduced to the drawer through the upper portion of the rear wall of the container 121 and the upper portion of the drawer (128, an inlet of the drawer), and discharged through the lower portion of the drawer (129, an outlet of the drawer) and the lower portion of the rear wall of the container 121.

The fan 141 that causes an air flow and the heater 142 that heats the air may be mounted between the rear wall of the drawer and the rear wall of the body. However, the mounting locations of the fan 141 and the heater 142 are not limited to this, but the hot air supply unit 140 of the fan 141 and the heater 142 can be mounted to anywhere on an flow passage through which the air is introduced/discharged.

FIG. 4 illustrates a mode in which the air is introduced through the upper portion of the drawer and discharged through the lower portion of the drawer. However, opposite to this, the air may be introduced through the lower portion of the drawer and discharged through the upper portion of the drawer.

In the meantime, referring to FIG. 4, the laundry 162 is seated in the drawer 122, and the drawer 122 may have a shelf 160 which divides the inside space of the drawer in an upper portion and a lower portion while making the upper portion and the lower portion in communication. Such a shelf is provided for smooth discharge of the air supplied to the laundry 162.

It is preferable that the shelf has a plurality of pass through holes 160*a*. That is, air flows from the upper portion of the drawer to the lower portion of the drawer through the pass through holes.

Moreover, the shelf may be tilted. In this case, it is preferable that the shelf is tilted down in a direction of air inlet, for uniform supply of the air to the laundry seated on the shelf 160.

It is preferable that the drawer 122 has an air guide 161 at the upper portion of the rear wall, for smooth supply of the air up to a front of the drawer 122 and functioning to separate an air introduction flow passage from an air discharge flow passage, which minimizes collision between air being introduced and air being discharged for enhancing efficiency of drying.

In the meantime, a variety of drying modes may be performed by using the pedestal type dryer of the present invention.

At first, the user draws out the drawer 122, and places laundry, such as a small amount of fabric, shoes, or a cap, on the shelf 160. If the laundry is the fabric, it is preferable that the fabric is spread on the shelf.

Then, the user selects a desired operation mode at the input unit on the control unit 123 according to a kind of the laundry. The operation mode may be one of a variety of the drying modes, or the refresh mode.

The variety of the drying modes may be modes of various drying time periods, or various drying temperatures, which vary with kinds of laundry to be dried. For an example, for drying a small amount of fabric of cotton, the drying mode may be set such that the drying time period is short and the drying temperature is high, and for drying shoes, the drying mode may be set such that the drying time period is long and the drying temperature is low.

Though the air is forcibly supplied to the space having the laundry placed therein according to the operation mode the user selects, the air temperature and the air supply time period are varied.

Moreover, if the operation mode is the refresh mode, high temperature steam is supplied to the laundry. According to this, refresh of the laundry is made with the steam. That is, deodoring, removal of creases, or sterilizing of laundry is made. Then, air may be supplied as required for drying.

Industrial Applicability

A new conceptual pedestal type dryer can be provided, which can dry a small amount of laundry without operating a relatively large laundry treating machine, and also can serve as a pedestal of a dryer or a washing machine.

Different from the related art dryer, a pedestal type dryer can be provided, which is favorable or energy saving, noiseless, compact because the pedestal type dryer is not a drum type dryer.

Moreover, a pedestal type dryer can be provided, which can prevent accident caused by negligence of safety from taking place even when a current leaks from the heater.

The invention claimed is:

1. A pedestal type dryer comprising:

a container having a space formed therein, an inlet formed in an upper portion of a rear wall for introduction of external air, an outlet formed in a lower portion of the rear wall for discharging the air, and a top provided to install a laundry dryer, or a washing machine;

a drawer having a laundry holding space for holding the drying object and being drawn in a front direction from the space of the container; and a hot air supply unit having a fan for blowing air, and a heater, for supplying hot air to the space for holding the drying object, wherein the drawer has an inlet provided in an upper portion of a rear wall of the drawer to communicate with the inlet of the container and an outlet provided in a lower portion of the rear wall of the drawer to communicate with the outlet of the container, and the inlet of the drawer and the outlet of drawer are separated from each other along a longitudinal direction of the rear wall of the drawer, and an air guide is provided to the rear wall of the drawer for guiding the air introduced to the drawer through the inlet of the drawer to a front side of the drawer, and the air guide is located between the inlet of the drawer and the outlet of the drawer.

2. The dryer as claimed in claim 1, further comprising:

a steam supply unit in the container for supplying steam to the space for holding the drying object, and a main control unit for controlling operation of the steam supply unit.

3. The dryer as claimed in claim 1, further comprising:

a shelf for seating the drying object thereon, and dividing the space into an upper portion and a lower portion while enabling communication between the upper portion of the shelf and the lower portion of the shelf.

4. A washing or drying composite machine comprising:

a pedestal type dryer including:

a container having a space formed therein, an inlet formed in an upper portion of a rear wall for introduction of external air, an outlet formed in a lower portion of the rear wall for discharging the air, and a top provided to install a laundry dryer, or a washing machine, a drawer having a laundry holding space for holding the drying object and being drawn in a front direction from the space of the container;

a hot air supply unit having a fan for blowing air, and a heater, for supplying hot air to the space for holding the drying object, and a machine mounted on the top of the container for washing or drying laundry, wherein the drawer has an inlet provided in an upper portion of a rear wall of the drawer to communicate with the inlet of the container and an outlet provided in a lower portion of the rear wall of the drawer to communicate with the outlet of the container, and the inlet of the drawer and the outlet of drawer are separated from each other along a longitudinal direction of the rear wall of the drawer, and an air guide is provided to the rear wall of the drawer for guiding the air introduced to the drawer through the inlet of the drawer to a front side of the drawer, and the air guide is located between the inlet of the drawer and the outlet of the drawer.

5. The dryer as claimed in claim 1, wherein the shelf is tilted down toward the rear wall of the drawer.

6. The dryer as claimed in claim 1, wherein the heater is located between the inlet of the container and the inlet of the drawer, and the fan is located between the outlet of the container and the outlet of the drawer.

7. The dryer as claimed in claim 1, wherein the heater is a PTC heater.

* * * * *